US009427632B2

(12) United States Patent
Breier et al.

(10) Patent No.: US 9,427,632 B2
(45) Date of Patent: Aug. 30, 2016

(54) GOLF CLUB HEADS WITH ENLARGED GROOVES

(71) Applicant: Cobra Golf Incorporated, Carlsbad, CA (US)

(72) Inventors: Joshua G. Breier, Vista, CA (US); Douglas E. Roberts, Carlsbad, CA (US); James G. Lewis, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 290 days.

(21) Appl. No.: 14/450,458

(22) Filed: Aug. 4, 2014

(65) Prior Publication Data

US 2014/0342846 A1 Nov. 20, 2014

Related U.S. Application Data

(62) Division of application No. 13/085,396, filed on Apr. 12, 2011, now Pat. No. 8,827,832.

(51) Int. Cl.
*A63B 53/04* (2015.01)

(52) U.S. Cl.
CPC ..... *A63B 53/047* (2013.01); *A63B 53/04* (2013.01); *A63B 2053/0408* (2013.01); *A63B 2053/0416* (2013.01); *A63B 2053/0445* (2013.01); *A63B 2053/0479* (2013.01); *A63B 2209/00* (2013.01)

(58) Field of Classification Search
USPC ..... 473/324–350
See application file for complete search history.

(56) References Cited

U.S. PATENT DOCUMENTS

| | | | | |
|---|---|---|---|---|
| 3,172,667 | A | 3/1965 | Baker et al. | |
| 4,768,787 | A | 9/1988 | Shira | |
| 4,917,384 | A | 4/1990 | Caiati | |
| 5,643,110 | A | 7/1997 | Igarashi | |
| 5,688,186 | A | 11/1997 | Michaels et al. | |
| 5,755,626 | A | 5/1998 | Shira | |
| 5,857,922 | A | 1/1999 | Delio | |
| 6,059,670 | A | 5/2000 | Mogan | |
| 7,014,568 | B2 | 3/2006 | Pelz | |
| 7,192,361 | B2 | 3/2007 | Gilbert et al. | |
| 7,273,418 | B2 | 9/2007 | Gilbert et al. | |
| 7,594,862 | B2 * | 9/2009 | Gilbert | A63B 53/04 473/330 |
| 7,653,980 | B2 | 2/2010 | Vokey et al. | |
| 7,658,685 | B2 | 2/2010 | Vokey et al. | |
| 7,662,049 | B2 | 2/2010 | Park et al. | |
| 7,758,449 | B2 | 7/2010 | Gilbert et al. | |

(Continued)

FOREIGN PATENT DOCUMENTS

| | | | |
|---|---|---|---|
| JP | 05-096032 | A | 4/1993 |
| JP | 06-114128 | A | 4/1994 |

(Continued)

*Primary Examiner* — Alvin Hunter
(74) *Attorney, Agent, or Firm* — Brown Rudnick LLP; Mark S. Leonardo

(57) ABSTRACT

Golf club heads with enlarged grooves, wherein a portion of the finish adjacent or within the groove is removed to create the visual appearance of enlarged grooves. The surface finish of the groove enhancement area surrounding the groove is matched to be the same as the surface finish of the groove, preferably a bright, smooth or shiny metallic finish. This surface finish of the remainder of the striking face of the golf club is a second surface finish, preferably a dark or black matte, or rough finish. The contrast between the two finishes gives the perception that the grooves are larger than they are physically.

20 Claims, 8 Drawing Sheets

(56) References Cited

U.S. PATENT DOCUMENTS

| | | | | |
|---|---|---|---|---|
| 7,780,549 | B2 | 8/2010 | Park et al. | |
| 7,794,333 | B2 | 9/2010 | Wallans et al. | |
| 7,803,062 | B2 | 9/2010 | Gilbert et al. | |
| 7,846,039 | B2 * | 12/2010 | Gilbert | A63B 53/04 473/331 |
| 7,901,297 | B2 | 3/2011 | Ban et al. | |
| 7,927,230 | B2 | 4/2011 | Solheim | |
| 8,021,245 | B2 | 9/2011 | Beach | |
| 8,066,586 | B2 | 11/2011 | Solheim et al. | |
| 8,128,510 | B2 * | 3/2012 | Gilbert | A63B 53/04 473/330 |
| 8,206,240 | B2 | 6/2012 | Park et al. | |
| 8,262,504 | B2 | 9/2012 | Liu et al. | |
| 8,382,608 | B2 | 2/2013 | Solheim | |
| 8,834,291 | B2 * | 9/2014 | Ban | A63B 53/047 473/331 |
| 2006/0025233 | A1 | 2/2006 | Lin | |
| 2007/0135229 | A1 | 6/2007 | Lo et al. | |
| 2008/0045351 | A1 | 2/2008 | Vokey et al. | |
| 2008/0051212 | A1 | 2/2008 | Voges | |
| 2009/0264217 | A1 | 10/2009 | Johnson et al. | |
| 2009/0305812 | A1 | 12/2009 | Nakamura | |
| 2009/0318243 | A1 | 12/2009 | Golden et al. | |
| 2010/0029405 | A1 | 2/2010 | Gilbert | |
| 2010/0087270 | A1 | 4/2010 | Ban et al. | |
| 2010/0113180 | A1 | 5/2010 | Nakamura | |
| 2010/0190572 | A1 | 7/2010 | Vokey et al. | |
| 2010/0279791 | A1 | 11/2010 | Park et al. | |
| 2010/0285898 | A1 | 11/2010 | Gilbert et al. | |
| 2011/0151998 | A1 | 6/2011 | Ban | |
| 2011/0151999 | A1 | 6/2011 | Ban | |
| 2011/0224016 | A1 | 9/2011 | Gilbert | |

FOREIGN PATENT DOCUMENTS

| | | | |
|---|---|---|---|
| JP | 08-052243 | A | 2/1996 |
| JP | 2000-342723 | A | 12/2000 |
| JP | 2002-153575 | A | 5/2002 |
| JP | 2004-136030 | A | 5/2004 |
| JP | 2004-141277 | A | 5/2004 |
| JP | 2005-224383 | A | 8/2005 |
| JP | 2007-325859 | A | 12/2007 |
| JP | 2011-125541 | A | 6/2011 |

* cited by examiner

GOLF CLUB HEADS WITH ENLARGED GROOVES

RELATED APPLICATIONS

This application is a divisional of U.S. patent application Ser. No. 13/085,396, filed Apr. 12, 2011, the contents of which are incorporated herein by reference in their entirety.

FIELD OF THE INVENTION

The invention relates to golf club heads with grooves.

BACKGROUND OF THE INVENTION

Golf club heads come in many different forms and makes, such as wood-type or metal-type, iron-type (including wedge-type club heads), utility or specialty-type, and putter-type. Each of these types has a prescribed function and make-up. The invention will be discussed as relating to iron-type clubs, in particular, wedge-type club heads, but the inventive teachings disclosed herein may be applied to other types of clubs.

Iron-type golf club heads generally include a front or striking face, a back, a toe, a heel, a top line, a hosel, and a sole. The front face interfaces with and strikes the golf ball. A plurality of grooves, sometimes referred to as score lines, is provided on the face to assist in imparting backspin to the ball. The portion of the front face where impact with the golf ball is intended is referred to as the impact area. The back can also be described as the back of the striking face and may vary in design, depending whether the iron-type golf club head is a blade, muscle back or cavity back design. The hosel is generally configured to have a particular look to the golfer, to provide a lodging for the golf shaft, and to provide structural rigidity for the club head. The sole of the golf club is particularly important to the golf shot because it contacts and interacts with the playing surface during the swing. The toe is the region of the golf club head that is distal to the shaft, while the heel is the region of the golf club head that is proximal to the shaft. The top line is the uppermost region of the golf club head, extending between the toe and heel of the golf club head.

In conventional sets of iron-type golf clubs, each club includes a shaft with a club head attached to one end of the shaft, and a grip attached to the other end of the shaft. The angle between the striking face and a vertical plane is called the loft angle. Usually, the shaft is oriented vertically when the golfer holds the golf club in the proper address position.

The United States Golf Association (USGA) publishes and maintains the Rules of Golf, which govern golf in the United States. Appendix II to the USGA Rules provides limitations for golf clubs. Several of these rules are particularly relevant to the design of the grooves and the striking face. For example, the following USGA rules regulate the geometry of the grooves: grooves must be straight and parallel; grooves must have a plain symmetrical cross-section and sides which do not converge; the width, spacing and cross section of the grooves must be consistent throughout the impact area; the width of a groove cannot exceed 0.035 inch; the distance between edges of adjacent grooves cannot be less than three times the width of the grooves and not less than 0.075 inch; the depth of each groove cannot exceed 0.020 inch; the cross-sectional area of a groove divided by the groove pitch must not exceed 0.0030 $in^2/in$; grooves must not have sharp edges or raised lips; and groove edges must be substantially in the form of a round having an effective radius which is not less than 0.010 inch and not greater than 0.20 inch. Further, the surface roughness of the impact area cannot exceed that of decorative sandblasting or fine milling. The Royal and Ancient Golf Club of St Andrews (R&A), which is the governing authority for the rules of golf outside the United States, provides similar limitations to golf club design.

In 2008, the USGA announced the abovementioned new restrictions on groove design. Previous to 2008, the groove design rules were more lenient, which generally resulted in golf clubs, particularly wedges, with greater ball backspinning capability. Under the pre-2008 rules, manufacturers generally used the same U-shaped groove design, with maximum allowable width, depth, volume, and number of grooves. Further, manufacturers generally utilized sharp radii on the edge of the grooves. The similar groove designs across the manufacturers were a direct result of consumer demand—golf club designers found that the maximum-sized grooves produced the greatest ball backspin.

However, as a result of the changes to the groove design rules, manufacturers are asked to stop manufacturing golf clubs that do not comply with the new groove design rules starting in 2011, but can sell inventory of these pre-2008 rules golf clubs through 2011. For golf professionals, they are required to compete using golf clubs compliant with the new groove rules as of Jan. 1, 2010. For amateurs, generally they may continue to use their pre-2008 rules golf clubs through 2024, after which they will be required to use golf clubs that conform to the new groove design rules. However, amateurs may be impacted as early as 2011, due to the likely unavailability of pre-2008 rules golf clubs, since manufacturers will likely stop manufacturing golf clubs that have grooves according to the old groove design rules, and will likely only sell golf clubs having grooves conforming to the current groove design rules.

SUMMARY OF THE INVENTION

Golfers generally prefer iron golf clubs, particularly wedges, to be designed to produce the maximum of ball backspin. Generally, a large amount of ball backspin producing capability is desired for wedges, which are high lofted iron clubs (e.g., 45° to 70° loft angle). The large amount of ball backspin in a short distance golf shot (e.g., 5 to 100 yards) generally results in the golf ball taking a slightly lower trajectory, and stopping in a short distance upon hitting the ground, especially in soft turf conditions. In comparison, a golf club that does not produce a large amount of ball backspin results in a golf shot that has a higher trajectory, and which rolls a considerable distance beyond the point where it first hits the ground ("roll-out"). For many golfers, backspin is highly desirable for situations requiring a precise landing zone. For example, in a situation where the pin is located in a narrow portion of the green (and surround by hazards), a golf shot with large amounts of backspin is desirable because the golfer only has to consider where to land the ball, and the backspin will cause the ball to remain where it landed. In comparison, if the golfer used a wedge incapable of producing high amounts of backspin, the golfer would likely have to land the ball well before the pin, perhaps even before the green, which may result in a short shot that falls into a near-side hazard. If the golfer lands the ball on the green, the ball may roll away and trickle into a far-side hazard because of the lack of ball backspin preventing roll-out.

Further, if the golfer is highly skilled, the golfer's swing in combination with a high backspin producing wedge may cause the golf ball to land on the green, and then reverse course. Reversing course with the golf ball is desirable in situations where the golfer is short-sided, (i.e., the pin is very close to the edge of the green closest to the golfer, such that there is little distance between the start of the green and the pin, when measured in the distance and direction from the golfer to the pin). When short-sided, if the golfer can produce enough backspin for the ball to reverse course, the golfer then has the benefit of landing the ball anywhere behind the pin, and the ball will reverse course and roll backwards towards the pin. Without the ability to produce sufficient backspin to reverse course, the only recourse is for the golfer to land the ball short of the pin, hopefully without falling into a near-side hazard—otherwise, if the golfer lands the ball on the green, it will likely roll-out and roll well past the pin. Thus, it can be seen that a high ball backspin producing wedge is desirable for accuracy, in causing the ball to remain ("stick") approximately where it lands (or reverse course).

Various groove geometries, materials, and surface finishes have been implemented in order to achieve greater ball backspin on iron golf clubs, especially for wedges. With respect to groove geometries, a larger groove width and a larger groove depth generally results in greater ball backspin. Larger groove volume also generally results in greater ball backspin. Groove geometries where the radius between the groove side wall and the golf club striking face is small and sharp generally results in greater ball backspin. With respect to materials, softer materials including elastomeric ones generally create greater ball backspin. With respect to surface finishes, with a rougher finish, generally the result is greater ball backspin. These design differences achieve greater ball backspin by generally either increasing the friction between the ball and the golf club, or by reducing the interference of friction-reducing artifacts, such as channeling away water and debris using large volume grooves.

However, as discussed above, the USGA and R&A rules limit the design of grooves and surface finishes for golf irons and wedges, specifically with the goal to limit the ball back-spinning ability of today's modern golf clubs. Thus, some golf club head designs that result in high backspin are deemed to be nonconforming—for example, golf club irons and wedges with: grooves dimensioned larger than the USGA rules; grooves having a radius between the striking face and groove side wall smaller and sharper than specified by the USGA rules; striking faces made of a nonmetallic material such as rubber; striking face surface roughness exceeding the USGA rules. In the interest of complying with the USGA rules and marketability, most manufacturers are designing and selling only golf club irons and wedges that are fully conforming. Therefore, in today's golf club marketplace, generally the only clubs available to a golfer, even if the golfer desires to use nonconforming clubs, are those that comply with the spin-reduced, post-2008 USGA rules.

While golf irons and wedges are not designed for as much precision as a putter, golf irons and wedges are nevertheless scoring clubs, as opposed to drivers and woods, which are distance clubs. That is, with irons (and especially wedges), a golfer intends to land the ball as close to the target (or pin) as possible, while with woods, the golfer intends to gain as much distance as possible. When using irons and wedges, the golfer assumes that the closer the golfer is to the pin, the closer the golfer's shot should land to the pin. For example, if a golfer is 170 yards away, the golfer may use a 5-iron (e.g., 29°) to traverse that 170 yard distance. The golfer's expectation may be that the golfer expects the ball to land anywhere on a 15 yard radius green, and not in any adjacent hazard. However, if the same golfer is only 100 yards away, the golfer may use a pitching wedge (e.g., 48°) to traverse that distance, but the golfer's expectation will be that the ball should land within 25 feet of the pin, and not just anywhere on the green.

In the short game, a golfer typically uses high lofted wedges, and because the distance to the target is shorter, the expectation of the result is proportionally greater. For example, if the same golfer is only 40 yards away from the pin, the golfer may use a sand wedge (e.g., 54°) and expect to land the golfer's ball within 15 feet of the pin. However, if the same golfer is only 15 yards away from the pin, the golfer may use a lob wedge (e.g., 60°) and expect to land the golfer's ball within 5 feet of the pin.

Given the proportionally greater expectation for precision with higher lofted wedges, the ball back-spinning ability of the wedges is very important. The ball back-spinning ability of the wedges is even more important when used to escape a bunker or rescue a ball from the heavy rough. For example, when striking a ball from the heavy rough, grass and water will typically be trapped between the ball and striking face upon impact. The grass and water will dramatically reduce the resulting ball backspin, because they interfere with the clean, friction-producing striking face of the golf club. However, large grooves on a golf club may allow the grass and water to be channeled away, thereby resulting in greater ball spin than with smaller grooves. However, even with large grooves, it is often the case that a ball hit from the rough will have less backspin than the same ball hit from the fairway, because inevitably some grass and water will interfere with the striking face of the club.

As it is evident to the golfer of ordinary skill in the art, golf is as much a mental challenge as it is a physical challenge. The mental aspect can be highlighted in the frequent occasions where a golfer misses a critical five foot putt (perhaps for a championship win)—where five foot putts in noncompetition situations are consistently made, even by young children. Especially with respect to golf irons and especially wedges, it is imperative for the golfer to have the utmost confidence in the golfer's clubs. For example, for distance control, a golfer may demand that the golfer's 7 iron (e.g., 36°) travels precisely 150 yards, and the golfer's 8 iron (e.g., 40°) exactly 10 yards less at 140 yards. For wedges that are specialized for the short game, distance control is even more important. For example, the golfer may demand that for a 15 yard chip shot, the golfer's sand wedge (e.g., 54°) travels 7.5 yards in the air, and rolls 7.5 yards after landing, while if the golfer used the golfer's lob wedge (e.g., 60°), the golfer may expect the ball to travel 10 yards in the air, and roll 5 yards. Thus, the consistent performance of a golfer's golf clubs inspire confidence, which usually leads to better accuracy and scores.

In addition to confidence from consistently performing golf clubs, the golfer gains confidence from golf clubs that generally inspire confidence due to their design. For example, a large, 460 cc driver may instill confidence in a golfer because the large club head looks like the golfer can swing for the fences and never worry about mis-hitting or missing the ball. Similarly, for golf irons and especially wedges, large grooves inspire confidence because the golfer is convinced that the club will generate massive amounts of ball backspin, allowing the golfer to precisely hit the golfer's target and not roll-out. Moreover, design features that emphasize the large grooves, such as contrasting colors, will further instill confidence by making the large grooves appear even bigger than they are physically.

As discussed above, the USGA rules limit the size of the grooves, and therefore, the groove geometries are generally the same (i.e., at the maximum dimensions) between manufacturers. The USGA and R&A rules concerning surface roughness and groove geometry should not be considered as limitations to any embodiments discussed in this application, except where expressly acknowledged as a limitation. However, considering the mental aspect of the golf game, Applicants have determined that there is a distinct, confidence-building advantage in creating the appearance that the grooves are larger than they physically are, without breaking the USGA rules, resulting in a conforming golf club.

In one embodiment of the invention, the grooves of a golf club iron head are surrounded by groove enhancement areas that have a surface finish identical to that of the grooves, but different from the remainder of the striking face. This results in the appearance that the grooves are as large as the grooves plus the surrounding groove enhancement areas, without breaking the USGA design rules. For instance, the confidence derived from the perception that the grooves are larger than they are physically, could cause a golfer to hit the ball with more purposeful intent. That is, to confidently hit the ball with an accelerating blow, which will produce a good amount of ball backspin—as opposed to glancing the ball with a decelerating swing, which leads to a lack of ball backspin, which may be the case if the golfer lacks confidence in his golf club.

In another embodiment, the grooves themselves have a surface finish identical to that of the striking face, and the groove enhancement areas surrounding the grooves have a second surface finish that emphasizes the grooves. In another embodiment, only the bottom of the grooves themselves have a surface finish identical to that of the striking face, and the side walls of the grooves and the groove enhancement areas surrounding grooves have a second surface finish that emphasizes the grooves.

DESCRIPTION OF THE DRAWINGS

The invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
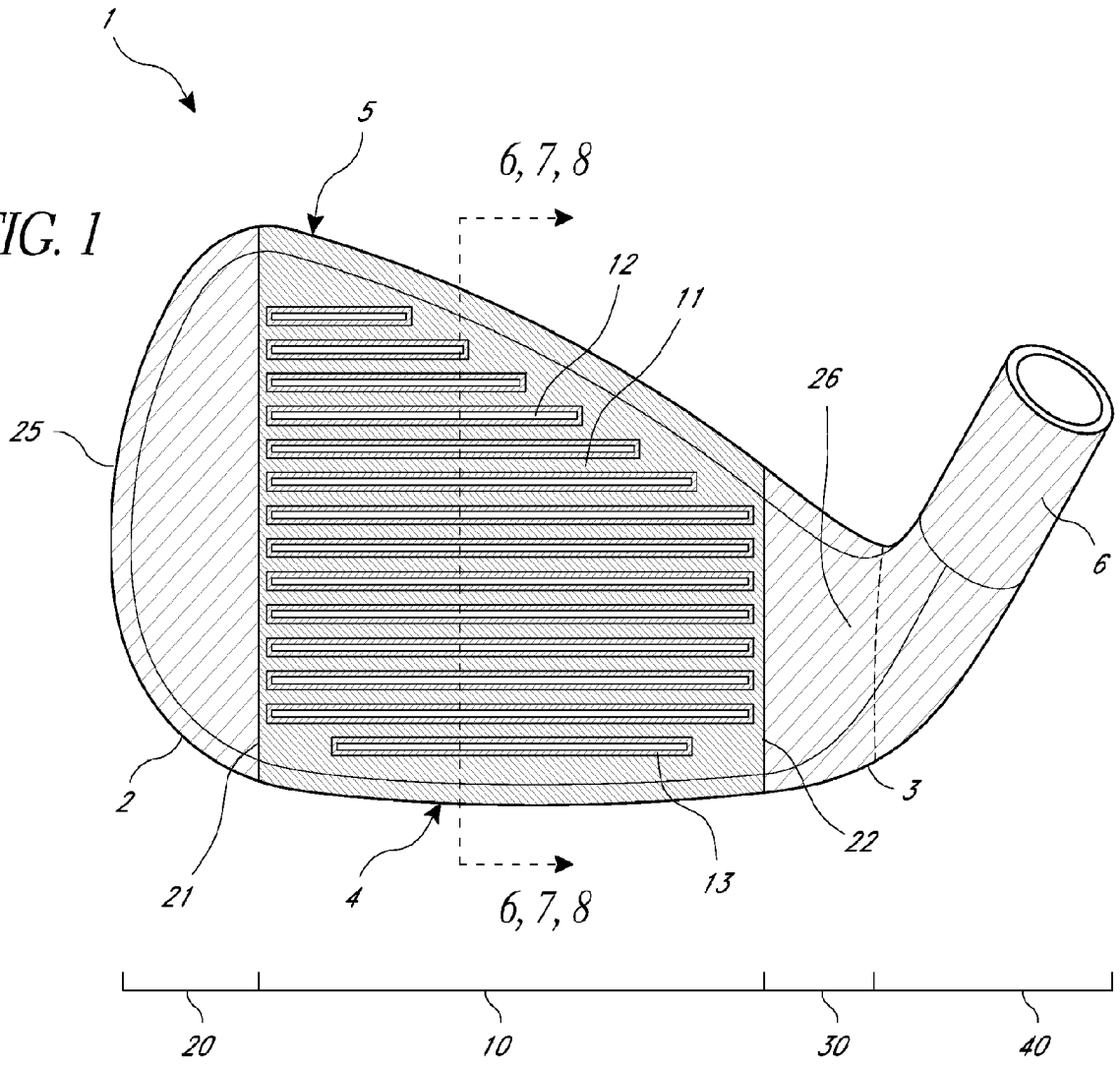
FIG. 1 is an elevational view of an embodiment of the golf club head of the invention, when viewed in a direction tangent to the striking face of the golf club head.
Figure 2:
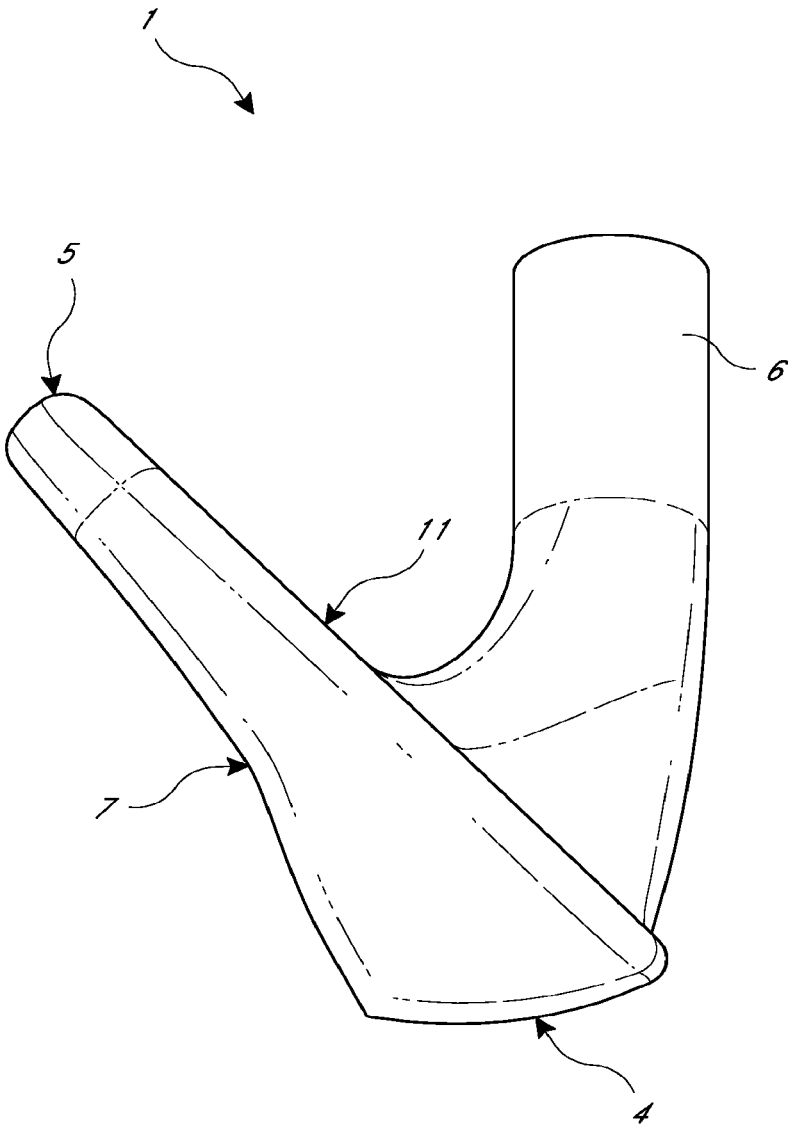
FIG. 2 is a left elevational view of an embodiment of the golf club head of the invention.

FIG. 1 is an elevational view of an embodiment of the golf club head of the invention, when viewed in a direction tangent to the striking face of the golf club head. FIG. 2 is a left elevational view of an embodiment of the golf club head of the invention. In FIGS. 1 and 2, the golf club head 1, is comprised of a toe 2, heel 3, sole 4, top line 5, hosel 6, and back 7. Further, the club has a striking face 11, which contacts the ball at impact. The golf club head is shown as having four regions when viewed from this perspective. The region denoted by 10 is called the impact area, which is at the center portion of the striking face and is intended to be where the golf ball contacts the club at impact. Region 20 is the toe region of the golf club and is separated from the impact area by the demarcation 21. Heel region 30 is separated from the impact area by the demarcation 22. The hosel region is indicated by region 40 and is not intended to incur impact with the golf ball. Instead, the golf club head is attached to a golf club shaft (not shown) through mechanical connection in this hosel area.

Further, the impact area contains at least one groove 12, and preferably a plurality of grooves. In one embodiment, at least one groove 12 is on the striking face, and is oriented horizontally such that the groove extends from heel to toe. Further, the groove 12 is surrounded by a groove enhancement area 13, which is also on the striking face. In other embodiments a plurality of grooves are surrounded by a plurality of groove enhancement areas. In some embodiments, groove enhancement area 13 roughly resembles the width and height of the encapsulated groove, although the groove enhancement area has a predetermined height and width that is larger than the height and width of the encapsulated groove. Further, the groove enhancement area 13 can have a different surface finish compared to the remainder of the striking face 11 and/or a different surface finish compared to the groove 12. The differences in the surface finish between the groove enhancement area 13, groove 12, and the striking face 11 allow for certain design advantages over the conventional golf club head that has a single surface finish for the entire striking face or the entire striking face and the grooves. Further, the toe area 25 and heel area 26 can have a surface finish, which may be the same or different from the surface finish of the groove enhancement area 13, groove 12, and the striking face 11. Generally, two adjacent groove enhancement areas 13 that surround two adjacent grooves 12 are separated with the surface finish of the striking face 11. That is, generally, two adjacent groove enhancement areas 13 do not touch one another—so as to form one larger groove enhancement area.

Figure 3:
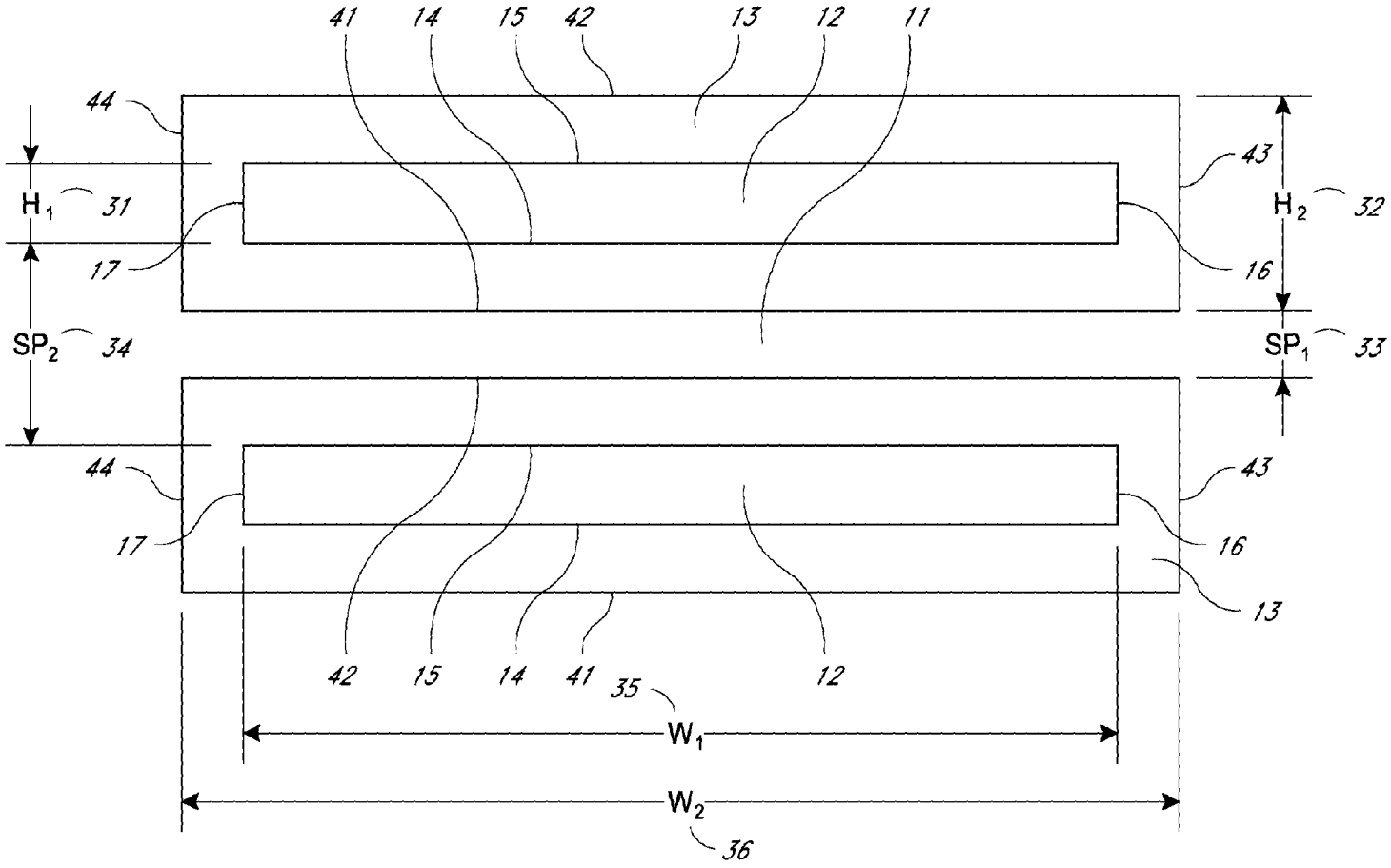
FIG. 3 is a close up view of an embodiment of the golf club head of the invention, showing the detailed area of the striking face and two adjacent grooves and groove enhancement areas on the face.

FIG. 3 is a close up view of an embodiment of the golf club head of the invention, showing the detailed area of the striking face and two adjacent grooves and groove enhancement areas on the face. FIG. 3 is not drawn to scale, but is a representation of one embodiment of the golf club. In FIG. 3, the striking face 11 contains at least one groove 12 that is oriented on the striking face, extending in the heel to toe direction. The groove 12 is surrounded or encapsulated by at least one groove enhancement area 13, which is oriented on the striking face. The groove 12 is defined by a height $H_1$ 31, and a width $W_1$ 35. The groove 12 has an upper sidewall 15, lower sidewall 14, and two end walls 16 and 17. These walls define the geometry of the groove, along with the depth of the groove (not shown). In this embodiment, the groove 12 is rectangular.

The groove enhancement area 13 is defined by a height $H_2$ 32, and a width $W_2$ 36. The groove enhancement area 13 is bounded by and upper line 42, a lower line 41, and two end lines 44 and 43. These lines define the contour of the groove enhancement area 13. The distance between the lower sidewall 14 of one groove and the upper sidewall 15 of a second adjacent groove is defined by $SP_2$ 34. The distance between the lower line 41 of one groove enhancement area, and the upper line 42 of a second adjacent groove enhancement area, is defined by $SP_1$ 33. In this embodiment, the groove enhancement area 13 is rectangular. The groove pitch is defined as $H_1$ 31 plus $SP_2$ 34, which is the distance between the upper sidewalls 15 of two adjacent grooves. The groove enhancement area pitch is defined as $H_2$ 32 plus $SP_1$ 33, which is the distance between the upper lines 42 of two adjacent groove enhancement areas. In one embodiment, the groove pitch and the groove enhancement area pitch are equal.

The vertical span of the groove enhancement area 13 is defined as $(H_2-H_1)/2$. The horizontal span of the groove enhancement area 13 is defined as $(W_2-W_1)/2$. In some embodiments, the horizontal span and vertical span of groove enhancement area 13 are the same. In one embodiment, the horizontal span is equal to the vertical span, which are both equal to the height of the groove 12. In other embodiments they may be different. In other embodiments, the groove enhancement area 13 is not directly centered around groove 12. For example, the upper vertical span of groove enhancement area 13 may be larger than the lower vertical span of groove enhancement area 13, but may be both smaller than the horizontal span of groove enhancement area 13. Similarly, the horizontal spans of the toe side and of the heel side of the groove enhancement area 13 may be different.

In some embodiments, the ratio of $H_1$ 31 to $H_2$ 32 may be 1:3, while in other embodiments, the ratio is 1:1.1, 1:1.25, 1:1.5, 1:1.75, 1:2, 1:2.5, 1:4 or 1:5. In some embodiments, the ratio of $W_1$ 35 to $W_2$ 36 may be 95:100, while in other embodiments, the ratio is 85:100, 90:100, 92.5:100, 97.5:100 or 99:100. In some embodiments, the ratio of $SP_1$ 33 to $H_2$ 32 (which would affect $H_1$ 31 and $SP_2$ 34) may be 1:3, while in other embodiments, the ratio is 4:1, 3:1, 2:1, 1.5:1; 1.25:1, 1.1:1, 1:1, 1:1.1, 1:1.25, 1:1.5, 1:1.75, 1:2, 1:2.5, 1:4 or 1:5. In some embodiments, the ratio of the groove enhancement area 13 to the area of the encapsulated groove 12 is 2:1, while in other embodiments, the ratio is 0.1:1, 0.25:1, 0.5:1, 0.75:1, 1:1, 1.25:1, 1.5:1, 2.5:1, 3:1, 4:1, 5:1. In some embodiments, the ratio of the striking face area (defined as $SP_1 \times W_2$) between adjacent groove enhancement areas 13 to the combined area of one groove enhancement area 13 plus the area of the encapsulated groove 12 is 1:3, while in other embodiments, the ratio is 4:1, 3:1, 2:1, 1.5:1; 1.25:1, 1.1:1, 1:1, 1:1.1, 1:1.25, 1:1.5, 1:1.75, 1:2, 1:2.5, 1:4 or 1:5.

As discussed above, the groove 12 or grooves 12 are described to be "on" or "oriented on" the striking face. The use of the terms "on" and "oriented on" in this context refers to the fact that the grooves 12 are recesses that are formed (e.g., milled, cast, etched, etc.) on or into the striking face. The groove 12 or grooves 12 are not said to be "on" or "oriented on" the striking face such that the lower wall of the groove 12 (i.e., the wall that defines the depth of the groove) is co-planar with the striking face. In addition, the groove enhancement area 13 or areas 13 are also described to be "on" or "oriented on" the striking face. The use of the terms "on" and "oriented on" in this context refers to the fact that the groove enhancement area 12 are located on the striking face, but not necessarily co-planar with the striking face. With respect to the relationship of the groove enhancement area 13 with the striking face 11, in some embodiments, the groove enhancement area 13 is co-planar with the striking face 11. In some embodiments, the groove enhancement area 13 is substantially co-planar with the striking face 11, with the difference being such that the surface roughness as measured in the combined areas of the striking face 11 and the groove enhancement area 13 does not exceed the maximum allowable surface roughness value set forth by the USGA or R&A rules. In some embodiments, the groove enhancement area 13 is substantially co-planar with the striking face 11, but that the surface roughness as measured in the combined areas of the striking face 11 and the groove enhancement area 13 exceeds the maximum allowable surface roughness value set forth by the USGA or R&A rules. In some embodiments, the groove enhancement area 13 is not co-planar with the striking face 11, and can be considered to form a portion of the groove 12 or grooves 12. Some embodiments comply with the USGA and R&A rules concerning surface roughness and groove geometry, as discussed above, while other embodiments do not comply with the USGA and R&A rules. The USGA and R&A rules concerning surface roughness and groove geometry should not be considered as limitations to any embodiments discussed in this application, except where expressly acknowledged as a limitation.

In one embodiment, the striking face 11 has a first surface finish, the groove 12 has a second surface finish, and the groove enhancement area 13 has a third surface finish. In some embodiments, the second surface finish for the groove 12 and the third surface finish for the groove enhancement area 13 are the same, while the first surface finish for striking face 11 is different. In some embodiments, the first, second and third surface finishes are all different. In other embodiments the first surface finish for the striking face 11 and the second surface finish for the groove 12 are the same, while the third surface finish for the groove enhancement area 13 is different.

In embodiments where the third surface finish of the groove enhancement area 13 is the same as the second surface finish of the groove 12, but are different from the first surface finish of the striking face 11, the similar surface finishes of the groove enhancement area 13 and groove 12 give the appearance that the grooves are visibly larger than they are physically. This is especially true when there is a large contrast between the similar surface finishes of the groove enhancement area 13 and groove 12 relative to the surface finish of the striking face 11. For example, the surface finish of the striking face 11 may be a dark or black surface finish with a matte texture, while the surface finishes for the groove enhancement area 13 and groove 12 are of a bright, smooth metallic finish.

In embodiments where the first surface finish of the striking face 11 is the same as the second surface finish of the groove 12, but are different from the third surface finish of the striking face 11, the difference surface finish of the groove enhancement area 13 visibly highlights and surrounds the groove 12. Again, the visual effect of the two different surface finishes can be enhanced by using a large contrast between the two surface finishes. For example, the surface finish of the striking face 11 and groove 12 may be a dark or black surface finish with a matte texture, while the surface finish for the groove enhancement area 13 is of a bright, smooth metallic finish. This gives the golf club head the visual appearance that there are many grooves present on the striking face. A similar but reverse effect can be achieved by using a bright, smooth metallic finish, such as chrome plating for striking face 11 and groove 12, but using a dark or black surface finish for groove enhancement area 13.

Further, in another embodiment, the differences in the surface finishes may depend only on the surface roughness and not on the color. For example, the surface finishes of the striking face 11, groove 12 and groove enhancement area 13 may be of one color. However, the groove 12 and groove enhancement area 13 may be of a smooth or shiny appearance, while the striking face 11 may be of a rough or heavily textured appearance, which may be desirable to produce increased friction to create more ball backspin. Yet, the similar shiny appearance of grooves 12 and groove enhancement area 13 provide the impression that the grooves are larger than they are physically. In another embodiment, the groove 12 may be of a smooth or shiny appearance, while the striking face 11 and groove enhancement area 13 may be of a rough or heavily textured appearance. In another embodiment, the groove enhancement area 13 may be of a smooth or shiny appearance, while the striking face 11 and groove 12 may be of a rough or heavily textured appearance. In another embodiment, the striking face 11 may be of a smooth or shiny appearance, while the groove 12 and groove enhancement area 13 may be of a rough or heavily textured appearance. In one embodiment, a smooth surface finish may have a surface roughness of less than 120 μin. In another embodiment, a smooth surface finish may have a surface roughness of less than 50 μin. In another embodiment, a smooth surface finish may have a surface roughness of less than 30 μin. In another embodiment, a smooth surface finish may have a surface roughness of less than 5 μin. In another embodiment, a smooth surface finish may have a surface roughness of about 5 μin. In one embodiment, a rough surface finish may have a surface roughness of greater than 120 μin. In one embodiment, a rough surface finish may have a surface roughness of greater than 200μin. In one embodiment, a rough surface finish may be greater than 500μin. In the embodiments disclosed in this application, surface roughness (e.g., 120μin) is technically known as the average surface roughness, $R_a$, which is defined as:

$$R_a = \frac{1}{n}\sum_{i=1}^{n} |y_i|$$

The average surface roughness, $R_a$, can be considered to be the arithmetic average of the absolute values of the vertical deviation of the roughness profile from the mean line. Again, some embodiments comply with the USGA and R&A rules concerning surface roughness as discussed above, while other embodiments do not comply with the USGA and R&A rules. The USGA and R&A rules concerning surface roughness should not be considered as limitations to any embodiments discussed in this application, except where expressly acknowledged as a limitation.

In another embodiment, either or both of the groove 12 and groove enhancement area 13 may have an unplated surface finish. That is, the base material of the golf club head in groove enhancement area 13 and groove 12 is exposed to the surrounding or ambient air, while the remainder of the striking face 11 is plated. This results in a golf club head that has a general plated appearance, except that the grooves 12 and groove enhancement area 13 will become rusty over time. For some golfers, the appearance of rust is a desirable feature, because generally the surface finish of the rust has greater friction than a smooth plated surface finish. Thus, in this embodiment, the rusty grooves 12 and rusty surrounding groove enhancement area 13 gives the impression of increased friction resulting in increased ball backspin. The actual increase in friction due to the rust may not be much greater than without, due to the small-sized nature of the groove enhancement area having the rusty surface finish. In other embodiments, only the groove enhancement area 13 is unplated, while the groove 12 and striking face 11 are plated, resulting in rust being created in the groove enhancement area 13 while the remainder of the club does not rust.

One benefit of the selective rusting in groove enhancement area 13 and/or groove 12 is the appearance of rust itself in the impact region that matters most (or at least matters most in impression), and no rust forming on the remainder of the golf club head, including other portions of the striking face 11. Some golfers like the appearance of rust in the grooves, but not on the other portions of the club head.

In one embodiment, additional surfaces can have a different surface finish, or be unplated to give a unique visual appearance, in accordance to the types of finishes and surface roughnesses discussed above. In one embodiment, the toe area 25 of toe region 20 and heel area 26 of heel region 30 can be unplated such that they will rust. Thus, in combination with the previous embodiment described above, the overall appearance of the striking face of the golf club head will be that the toe area 25, heel area 26, grooves 12 and areas 11 (or only the grooves 12, or only the areas 11) will all be rusted while the remainder of the impact region 10 of the striking face 11 and the hosel region 40 will be plated and not rusted. Moreover, the opposite can be achieved. For example, the toe area 25, heel area 26, hosel region 40, grooves 12, and surrounding groove enhancement areas 13 may be plated and not rusted. Only the impact region 10, with the exception of grooves 12 and surrounding area 11, is rusted. This embodiment results in a rusted, high friction impact region 10, but where the grooves 12 and surrounding groove enhancement areas 13 are highlighted because they are plated (and shiny), and where the remainder of the club including the toe area 25 and heel area 26 and hosel region 40 are plated and do not look dilapidated due to rust. In another embodiment, the finish of the club head is a thin film created using physical vapor deposition (PVD). This film (PVD finish) is deposited on top of the club head, where the impact region 10 is machine roughened to create a greater surface roughness, while other areas such as the lower surfaces of the grooves 12, toe area 25 and heel area 26 are machined or polished to have less surface roughness. In this embodiment, the toe area 25 and heel area 26 have a surface roughness of about 7 μin, the striking face 11 within the impact region 10 (not including the groove enhancement areas 13) has a surface roughness of about 80 μin when measured in a parallel direction to the grooves 12, and the lower surfaces of the grooves 12 have a surface roughness of about 15 μin. In this embodiment, the groove enhancement areas 13 surrounding the grooves 12 are added to the club head by laser etching (laser engraving) around the grooves 12 to remove the PVD finish, and results in a surface roughness of the groove enhancement areas 13 of about 77 μin when measured in a parallel direction to the grooves 12. To illustrate the difference between the overall surface roughness of a club head striking face 11 with and without the laser-etched groove enhancement areas 13, Applicants have determined that the striking face 11 within the impact region 10 (not including the groove enhancement areas 13) has a surface roughness of about 159 μin when measured in a perpendicular direction to the grooves 12, while with the laser-etched groove enhancement areas 13, the striking face 11 within the impact region 10 has a surface roughness of about 151 μin when measured in a perpendicular direction to the grooves 12. Accordingly, Applicants have concluded that laser etching (laser engraving) of the PVD finish, even when confined to select regions such as the groove enhancement areas 13, reduces the surface roughness of the striking face.

The surface finishes discussed above may vary depending on design choice and the examples given do not limit the types of surface finishes that may be used with this invention. Known surface finishes include: no plating or a hot oil finish that is designed to rub off, exposing the underlying metallic club head material, resulting in rust; nickel plating of various colors; anodizing of various colors; and chrome plating. Further, the surface roughness of the surface finishes discussed above may vary depending on design choice and examples given do not limit the range of surface roughness that may be used with this invention. For example, smooth or shiny surface finishes will have a small surface roughness value and will generally result in less friction. Rough, textured or matte finishes will have a larger surface roughness value and will generally result in more friction. Further the striking face of the golf club head may be textured, milled, cast, or otherwise created to have surface features or patterns that would create greater friction when compared to a similar striking face with the same measured surface roughness but without the textured, milled, cast or otherwise created surface features or patterns.

Figure 4:
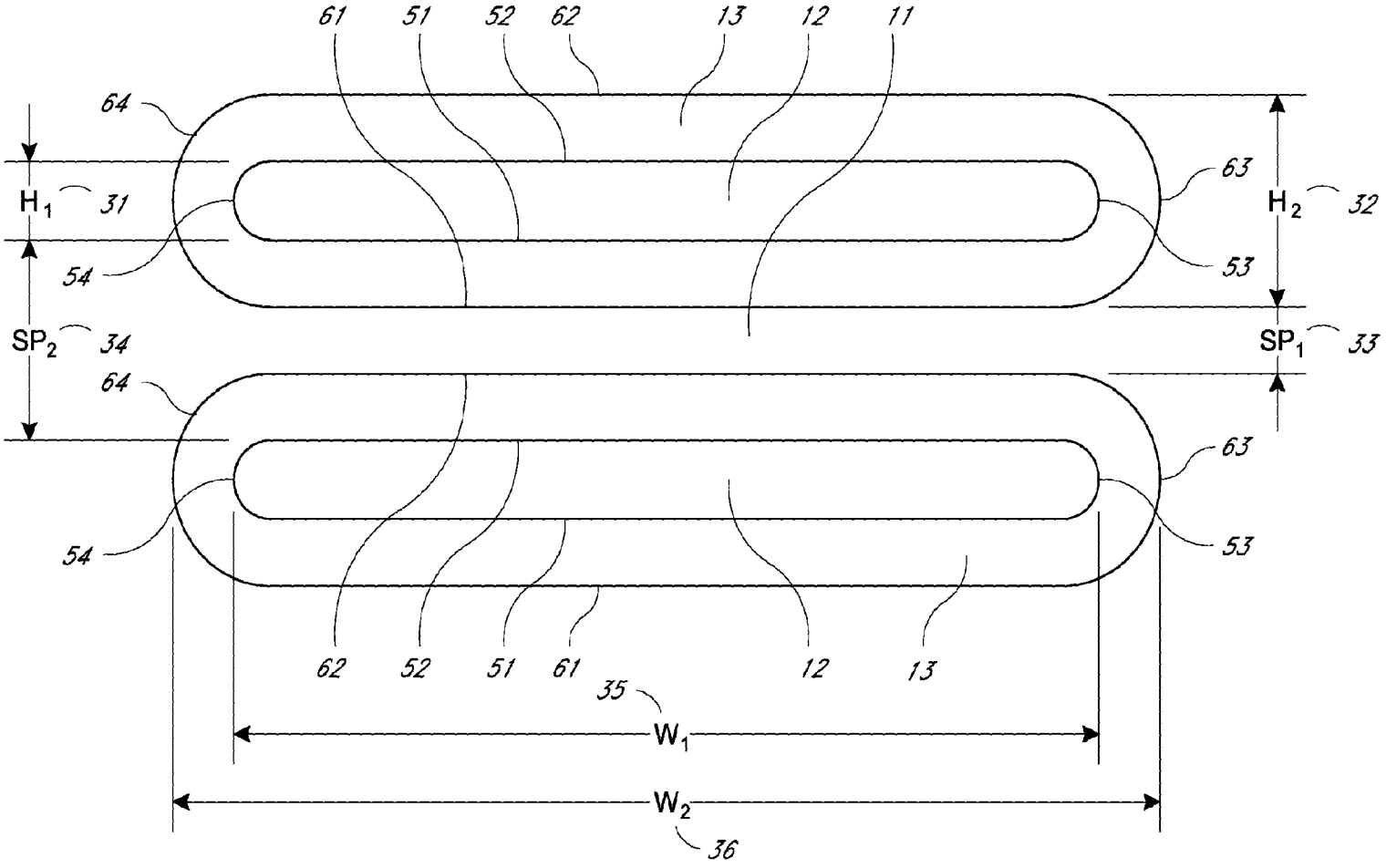
FIG. 4 is a close up view of another embodiment of the golf club head of the invention, showing the detailed area of the striking face and two adjacent grooves and groove enhancement areas on the face.

FIG. 4 is a close up view of another embodiment of the golf club head of the invention, showing the detailed area of the striking face and two adjacent grooves and groove enhancement areas on the face. FIG. 4 is not drawn to scale, but is a representation of one embodiment of the golf club. The embodiment shown in FIG. 4 is similar to the embodiment shown in FIG. 3, with the exception that the grooves 12 are oblong instead of rectangular, and the groove enhancement areas 13 are oblong instead of rectangular. In FIG. 4, the striking face 11 contains at least one groove 12, which is surrounded by at least one groove enhancement area 13. The groove 12 is defined by a height $H_1$ 31, and a width $W_1$ 35. The groove 12 has an upper sidewall 52, lower sidewall 51, and two end walls 54 and 53 which are curved or rounded. These walls define the geometry of the groove, along with the depth of the groove (not shown).

The groove enhancement area 13 is defined by a height $H_2$ 32, and a width $W_2$ 36. The groove enhancement area 13 is bounded by and upper line 62, a lower line 61, and two end curves 64 and 63. These lines define the contour of the groove enhancement area 13. The distance between the lower sidewall 51 of one groove and the upper sidewall 52 of a second adjacent groove is defined by $SP_2$ 34. The distance between the lower line 61 of one groove enhancement area, and the upper line 62 of a second adjacent groove enhancement area, is defined by $SP_1$ 33. The groove pitch is defined as $H_1$ 31 plus $SP_2$ 34, which is the distance between the upper sidewalls 52 of two adjacent grooves. The groove enhancement area pitch is defined as $H_2$ 32 plus $SP_1$ 33, which is the distance between the upper lines 62 of two adjacent groove enhancement areas. In one embodiment, the groove pitch and the groove enhancement area pitch are equal.

The vertical span of the groove enhancement area 13 is defined as $(H_2-H_1)/2$. In some embodiments, the profile of the curves 63 and 64 are not concentric with the curved end walls 53 and 54 respectively. In other embodiments, the profile of the curves 63 and 64 are not circular and are instead parabolic, hyperbolic, elliptical, or comprised of two or more segments. In one embodiment, the curves 63 and 64 of groove enhancement area 13 have a profile such that the distance between the outer profile of the groove enhancement area and the groove walls are the same around the entire perimeter of the groove. In other embodiments, such as ones where the curves 63 and 64 are not concentric or not circular, this distance is not the same around the entire perimeter of the groove.

In some embodiments, the ratio of $H_1$ 31 to $H_2$ 32 may be 1:3, while in other embodiments, the ratio is 1:1.1, 1:1.25, 1:1.5, 1:1.75, 1:2, 1:2.5, 1:4 or 1:5. In some embodiments, the ratio of $W_1$ 35 to $W_2$ 36 may be 95:100, while in other embodiments, the ratio is 85:100, 90:100, 92.5:100, 97.5:100 or 99:100. In some embodiments, the ratio of $SP_1$ 33 to $H_2$ 32 (which would affect $H_1$ 31 and $SP_2$ 34) may be 1:3, while in other embodiments, the ratio is 4:1, 3:1, 2:1, 1.5:1; 1.25:1, 1.1:1, 1:1, 1:1.1, 1:1.25, 1:1.5, 1:1.75, 1:2, 1:2.5, 1:4 or 1:5. In some embodiments, the ratio of the groove enhancement area 13 to the area of the encapsulated groove 12 is 2:1, while in other embodiments, the ratio is 0.1:1, 0.25:1, 0.5:1, 0.75:1, 1:1, 1.25:1, 1.5:1, 2.5:1, 3:1, 4:1, 5:1. In some embodiments, the ratio of the striking face area (defined as $SP_1 \times W_2$) between adjacent groove enhancement areas 13 to the combined area of one groove enhancement area 13 plus the area of the encapsulated groove 12 is 1:3, while in other embodiments, the ratio is 4:1, 3:1, 2:1, 1.5:1; 1.25:1, 1.1:1, 1:1, 1:1.1, 1:1.25, 1:1.5, 1:1.75, 1:2, 1:2.5, 1:4 or 1:5.

Figure 5:
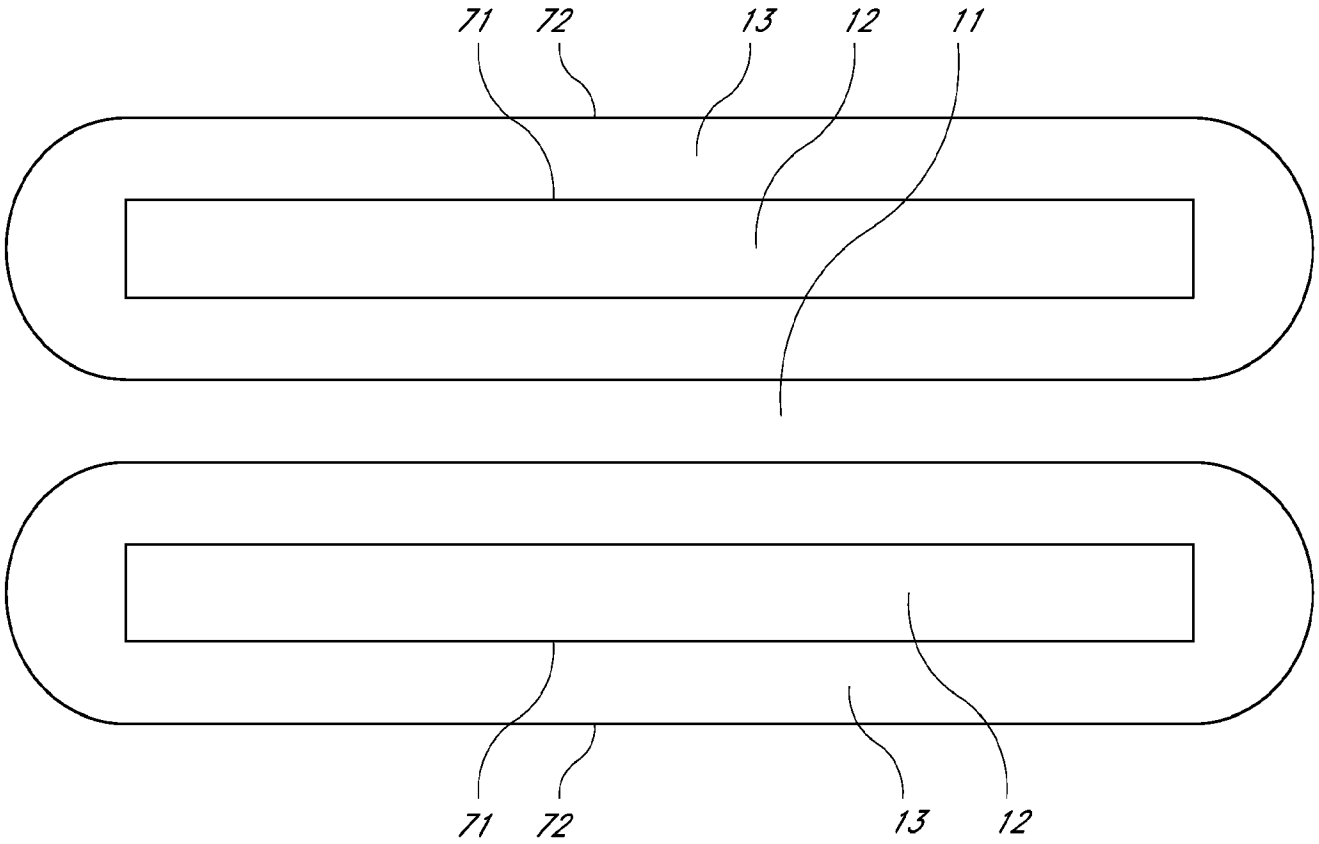
FIG. 5 is a close up view of another embodiment of the golf club head of the invention, showing the detailed area of the striking face and two adjacent grooves and groove enhancement areas on the face.

FIG. 5 is a close up view of another embodiment of the golf club head of the invention, showing the detailed area of the striking face and two adjacent grooves and groove enhancement areas on the face. FIG. 5 is not drawn to scale, but is a representation of one embodiment of the golf club. FIG. 5 is similar to FIG. 3 and FIG. 4, except that here, a combination of a rectangular groove 12 and an oblong groove enhancement area 13 are shown. The profile of the groove walls is shown by 71 and the outer contour of the groove enhancement area 13 is shown by 72. In another embodiment, the groove 12 has an oblong profile as described in FIG. 4, and the groove enhancement area 13 has a rectangular contour as described in FIG. 3.

Figure 6:
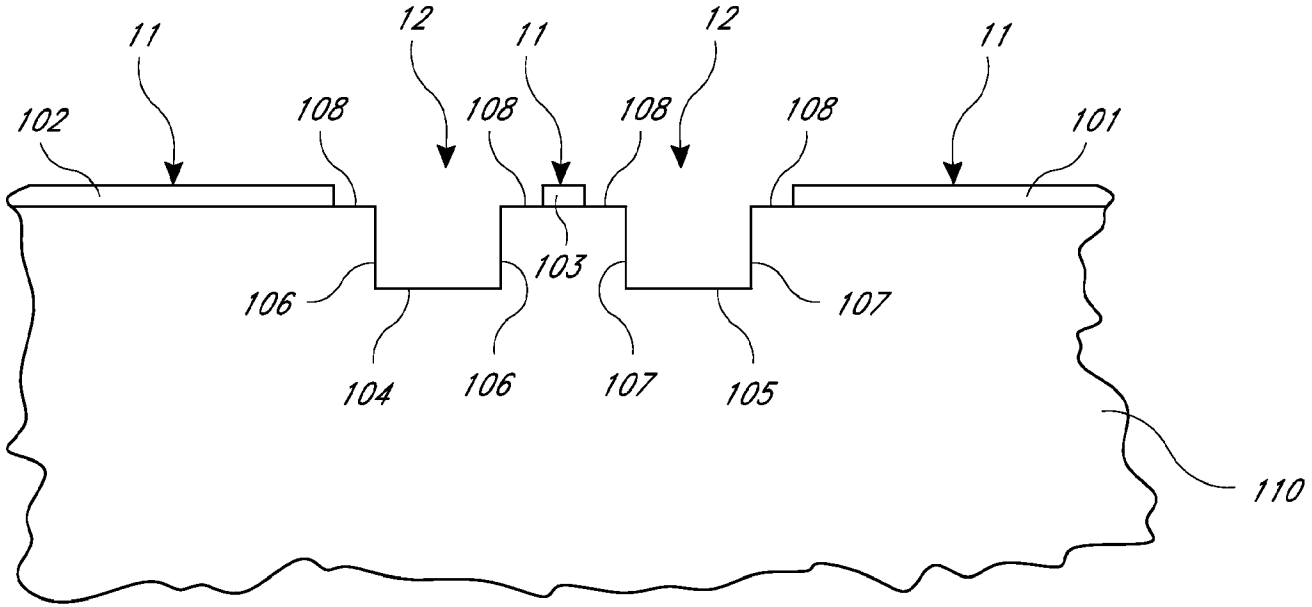
FIG. 6 is a cross-sectional view of an embodiment of the golf club head of the invention, corresponding to section 6 of FIG. 1, showing the detailed area of the striking face and two adjacent grooves and groove enhancement areas on the face.

FIG. 6 is a cross-sectional view of an embodiment of the golf club head of the invention, corresponding to section 6-6 of FIG. 1, showing the detailed area of the striking face and two adjacent grooves and groove enhancement areas on the striking face 11. FIG. 6 is not drawn to scale, but is a representation of one embodiment of the golf club. In this view, the top line of the club is oriented to the left of the view, and the sole is towards the right. The underlying golf club head body 110 is comprised of a first material, typically a metal or metallic alloy. The golf club head has a striking face 11 and grooves 12. The surrounding groove enhancement area 108 corresponds to groove enhancement area 13 discussed above, and is adjacent the top and bottom sidewalls of the grooves 12. The first groove 12 has a lower surface 104 and a top and bottom side wall 106. The second groove 12 has a lower surface 105 and a top and bottom side one 107. In one embodiment, the striking face 11 generally has a first surface finish 101, 102 and 103, while the surfaces 104, 105, 106, 107 and 108 have no surface finish, such that the underlying material 110 is exposed, resulting in a rusty finish. The first surface finish can be any known surface finish, such as the ones discussed above. For example, first surface finish 101, 102 and 103 may be a black nickel finish or a shiny chrome finish. This finish has a thin, but certain thickness. In one embodiment, one method of creating the design is to plate the entire golf club head striking face with one surface finish, then laser etch (or laser engrave) the surface finish off from surfaces 104, 105, 106, 107 and 108. Other known methods of removing surface finishes or plating may be chemical etch, milling, polishing, or other mechanical means of removal. In another embodiment, the similar design may be achieved by selectively plating the golf club head striking face, or by masking off surfaces 104, 105, 106, 107 and 108, and plating the entire golf club head striking face, and then removing the mask from the surfaces 104, 105, 106, 107 and 108 to expose the underlying material.

Figure 7:
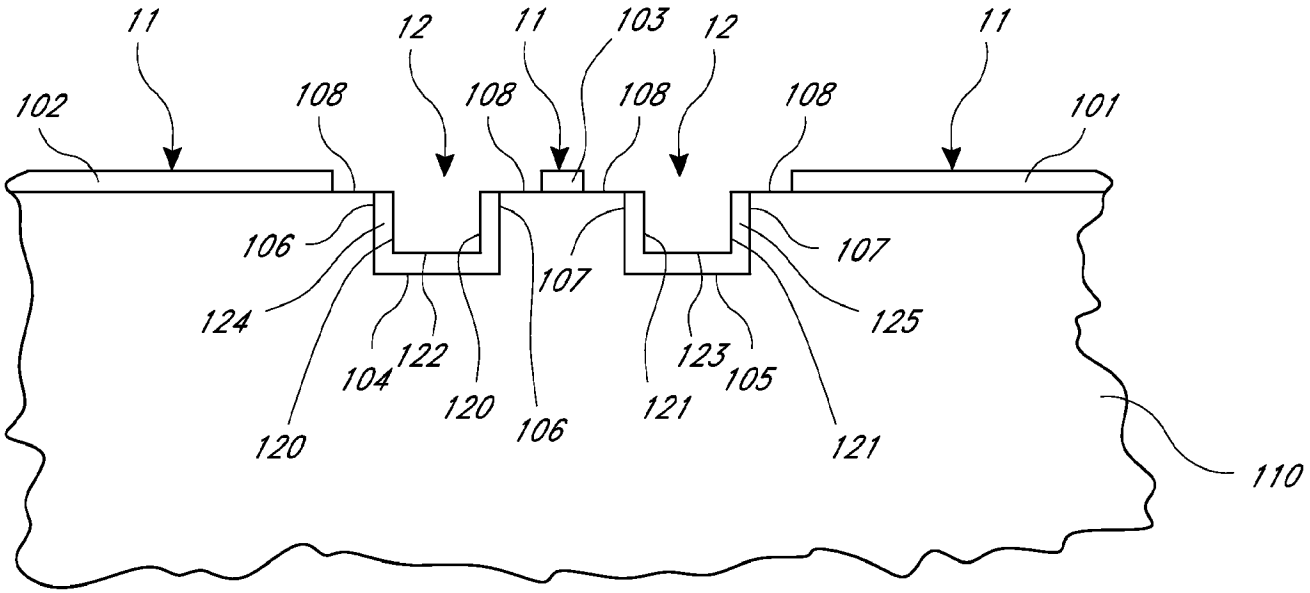
FIG. 7 is a cross-sectional view of another embodiment of the golf club head of the invention, corresponding to section 7 of FIG. 1, showing the detailed area of the striking face and two adjacent grooves and groove enhancement areas on the face.

FIG. 7 is a cross-sectional view of another embodiment of the golf club head of the invention, corresponding to section 7-7 of FIG. 1, showing the detailed area of the striking face and two adjacent grooves and groove enhancement areas on the face. FIG. 7 is not drawn to scale, but is a representation of one embodiment of the golf club. In this view, the top line of the club is oriented to the left of the view, and the sole is towards the right. FIG. 7 is similar to FIG. 6, except that the surfaces of the grooves 12 are now plated and have a second finish 124 and 125. Thus, the lower surfaces of the grooves 12 including the finish is 122 and 123 respectively, and the sidewalls of the grooves 12 including the finish is 120 and 121 respectively.

In one embodiment, the striking face 11 generally has a first surface finish 101, 102 and 103, while the surfaces 104, 105, 106, 107 and 108 have a second surface finish. The surface finishes can be any known surface finish, such as the ones discussed above. For example, first surface finish 101, 102 and 103 may be a black nickel finish. This finish has a thin, but certain thickness. Surfaces 104, 105, 106, 107 and 108 may have a second finish, such as a chrome finish. In designs where two separate finishes are contemplated, a selective plating or masking procedure may be used to plate the surfaces 104, 105, 106, 107 and 108 with the second surface finish, while not selectively plating or masking off the striking face to retain the surface finishes 101, 102 and 103. In a similar manner, a particular surface roughness can be achieved for the surfaces 104, 105, 106, 107 and 108, while a different surface roughness is given to the remainder of the striking face 11. Selective etching or mechanical methods may be employed to roughen or smooth particular surfaces, such as surfaces 104, 105, 106, 107 and 108, while a different surface roughness can be achieved by selectively etching or selectively using mechanical methods to separately roughen or smooth the remainder of the striking face.

In one embodiment, the surface finishes 101, 102 and 103 creating striking face 11 is the same as the surface finish 124 and 125 within the grooves, while only surface 108 exposes the underlying base metal 110, which will rust. In another embodiment, the surface finish 101, 102 and 103 creating striking face 11 is different from the surface finish 124 and 125 within the grooves. In another embodiment, the plating for two adjacent grooves 12 and their surrounding groove enhancement area 108 can be different. For example, surface finish 124 is different from the surface finish 125, which are both different from surface finish for surfaces 108 (the surface finish for surfaces 108 is not depicted). In another embodiment, surface finish 124 is a first surface finish, which is different from a second surface finish 125, and the striking face 11 may have a third finish 102 for a portion of the striking face, and a fourth finish 101 for a different portion of the striking face, and a fifth finish 103 for a different portion of the striking face. It can be seen that in combination with the disclosure above, various surface finishes for the different surfaces can be combined to create different visual effects, as well as different performance characteristics due to different surface roughnesses.

Figure 8:
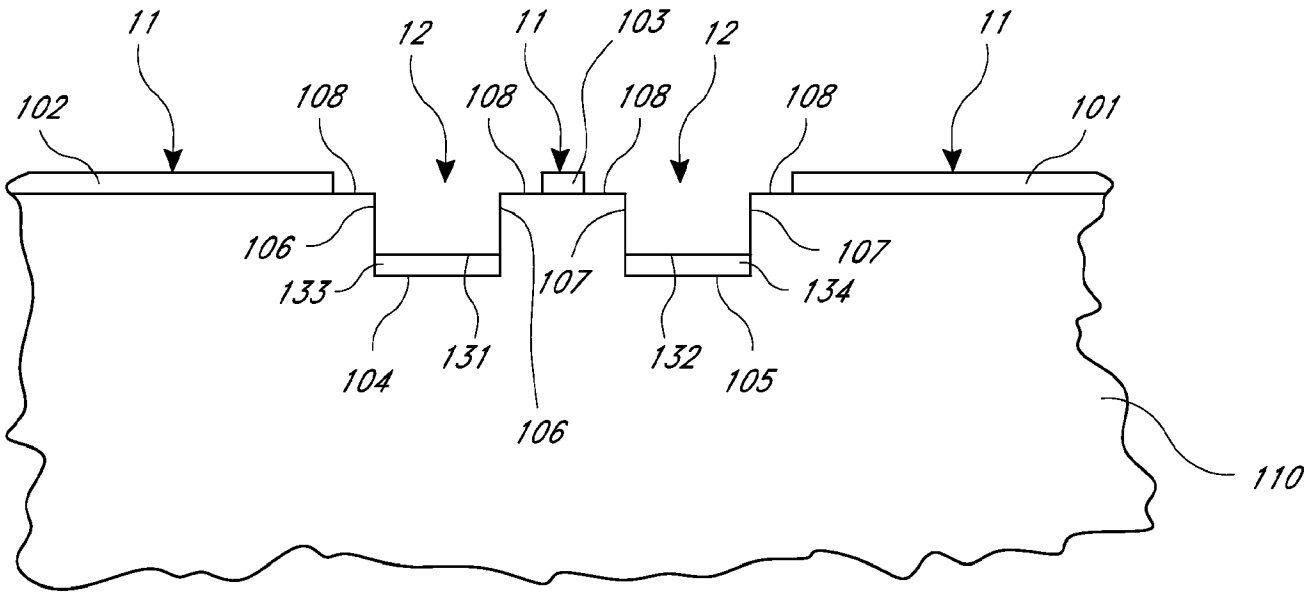
FIG. 8 is a cross-sectional view of another embodiment of the golf club head of the invention, corresponding to section 8 of FIG. 1, showing the detailed area of the striking face and two adjacent grooves and groove enhancement areas on the face.

FIG. 8 is a cross-sectional view of another embodiment of the golf club head of the invention, corresponding to section 8-8 of FIG. 1, showing the detailed area of the striking face and two adjacent grooves and groove enhancement areas on the face. FIG. 8 is not drawn to scale, but is a representation of one embodiment of the golf club. In this view, the top line of the club is oriented to the left of the view, and the sole is towards the right. FIG. 8 is similar to FIGS. 6 and 7, except that the surfaces of the grooves 12 are now plated and have a second finish 131 and 132, but yet the groove sidewalls 106 and 107 are unplated like surface 108, which will rust over time. The lower surface of the grooves 12 is shown as 131 and 132. In another embodiment, additionally one of either the top or bottom sidewalls 106 are plated, and the same corresponding sidewall in the adjacent groove is also plated 107. In one embodiment, if the sidewalls corresponding to the sole side of the club head is chrome plated, but the sidewalls corresponding to the top line side of the club head is not plated, then at address, the lower groove surface and groove sidewall will appear smooth and shiny. However, the groove sidewalls towards the top line of the club will rust over time, which will lead to increased friction—importantly, the rusting sidewall is on the side of the groove that bites into the golf ball, while the plated side does not bite as much into the golf ball during the swing. The fact that the rust appears only on the grooves' top line sidewalls, in combination with a larger appearing groove due to the chrome plating of the grooves' sole side sidewalls, may give a golfer the perception that the golf club will produce a great amount of friction. The rusted top line sidewalls of the groove may cause increased friction, but the increase in friction is likely to be less than that which the golfer perceives.

The groove designs contemplated in the embodiments of the invention are not limited to U-shaped or V-shaped grooves, or grooves only approved by the USGA. The teachings of this invention can be applied to various grooves of various geometries and designs. For example, the teachings of this invention can be applied to the following embodiments of grooves: extending horizontally from heel to toe; extending vertically from top line to sole; spiral patterned grooves; diagonally oriented grooves; grooves that overlap; circular or concentrically oriented grooves; wavy or zig-zag grooves; grooves that are oriented to form a logo or a pattern; grooves that criss-cross each other; grooves resembling the patterns of tire treads; grooves composed of individual indentations or dots. Similarly, the groove enhancement areas 13 surrounding the individual grooves are not limited to oblong or rectangular contours. Instead, the individual groove enhancement areas may be of any geometric profile, such as ones having a wavy or zig-zag outer profile line. In embodiments where the grooves themselves are not oblong or rectangular (e.g., spiral shaped, circular, etc.), the groove enhancement areas generally surround the individual grooves, but may themselves have a contour generally resembling the individual grooves (e.g., a spiral shaped groove enhancement area surrounding a spiral groove).

As used herein, directional references such as rear, front, lower, etc. are made with respect to the club head when grounded at the address position. See, e.g., FIGS. 1 and 2. The direction references are included to facilitate comprehension of the inventive concepts disclosed herein, and should not be read as limiting.

While the preferred embodiments of the invention have been described above, it should be understood that they have been presented by way of example only, and not of limitation. It will be apparent to persons skilled in the relevant art that various changes in form and detail can be made therein without departing from the spirit and scope of the invention. For example, while the inventive concepts have been discussed predominantly with respect to iron-type golf club heads, such concepts may also be applied to other club heads, such as wood-types, hybrid-types, and putter-types. Thus the invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a body defining a striking face, a top line, a sole, a heel, and a toe, wherein the body is primarily formed of a first metallic material and at least a portion of the striking face has a first surface finish;

at least one groove oriented on the striking face; and a groove enhancement area oriented on the striking face and surrounding the at least one groove, the groove enhancement area having no surface finish;

wherein the first metallic material of the body is exposed in the groove enhancement area.

2. The golf club head of claim 1, wherein the at least one groove has no surface finish and the first metallic material of the body is exposed in the at least one groove.

3. The golf club head of claim 2, wherein the exposed first metallic material in the groove enhancement area and the at least one groove oxidizes with ambient air to form a rusted layer.

4. The golf club head of claim 1, wherein the at least one groove has a second surface finish that is the same as the first surface finish.

5. The golf club head of claim 1, wherein the first surface finish has an average surface roughness of less than 120 μin.

6. The golf club head of claim 1, wherein the at least one groove has a second surface finish that is different from the first surface finish.

7. The golf club head of claim 6, wherein the second surface finish has an average surface roughness of greater than 120 μin.

8. The golf club head of claim 1, wherein a portion of the striking face proximate the heel and a portion of the striking face proximate the toe have no surface finish and the first metallic material of the body is exposed in the heel and toe portions of the striking face.

9. The golf club head of claim 8, wherein the exposed first metallic material in the heel and toe portions of the striking face oxidizes with ambient air to form a rusted layer.

10. A golf club head, comprising:

a body defining a striking face, a top line, a sole, a heel, and a toe, wherein the body is primarily formed of a first metallic material and at least a portion of the striking face has a plated surface;

a first groove and an adjacent second groove oriented on the striking face and extending between the heel and the toe;

a first groove enhancement area oriented on the striking face and surrounding the first groove, the first groove enhancement area having an unplated surface; and a second groove enhancement area oriented on the striking face and surrounding the second groove, the second groove enhancement area having an unplated surface;

wherein the first metallic material of the body is exposed in the first and second groove enhancement areas.

11. The golf club head of claim 10, wherein the first and second grooves have unplated surfaces and the first metallic material of the body is exposed in the first and second grooves.

12. The golf club head of claim 11, wherein the exposed first metallic material in the first and second grooves and the first and second groove enhancement areas oxidizes with ambient air to form a rusted layer.

13. The golf club head of claim 10, wherein the first and second grooves have plated surfaces.

14. The golf club of claim 13, wherein the plated surfaces of the striking face, the first groove, and the second groove are selected from the group consisting of nickel plating and chrome plating.

15. The golf club head of claim 10, wherein the first and second grooves have a hot oil finish configured to wear away and expose the first metallic material of the body in the first and second grooves.

16. The golf club head of claim 15, wherein the exposed first metallic material in the first and second grooves oxidizes with ambient air to form a rusted layer.

17. The golf club head of claim 10, wherein the plated surface of the striking face has an average surface roughness of less than 120 μin.

18. A golf club head, comprising:

a body defining a striking face, a top line, a sole, a heel, and a toe, wherein the body is primarily formed of a first metallic material and at least a portion of the striking face has a first surface finish;

at least one groove oriented on the striking face and extending between the heel and the toe, the at least one groove having no surface finish;

a groove enhancement area oriented on the striking face and surrounding the at least one groove, the groove enhancement area having no surface finish;

a heel region of the striking face proximate the heel has no surface finish; and a toe region of the striking face proximate the toe has no surface finish;

wherein the first metallic material of the body is exposed in the at least one groove, the groove enhancement area, and the heel and toe regions.

19. The golf club head of claim 18, wherein the exposed first metallic material in the at least one groove, the groove enhancement area, and the heel and toe regions oxidizes with ambient air to form a rusted layer.

20. The golf club head of claim 18, wherein the first surface finish has an average surface roughness of less than 120 μin.

* * * * *